United States Patent [19]

Scarselletta

[11] Patent Number: 4,645,000

[45] Date of Patent: Feb. 24, 1987

[54] TUBE AND FIN HEAT EXCHANGER

[75] Inventor: Louis Scarselletta, Lockport, N.Y.

[73] Assignee: General Motors Corporation, Detroit, Mich.

[21] Appl. No.: 853,902

[22] Filed: Apr. 21, 1986

[51] Int. Cl.[4] ..... F28D 1/02

[52] U.S. Cl. ..... 165/152; 165/906

[58] Field of Search ..... 165/152, 153, 906

[56] References Cited

U.S. PATENT DOCUMENTS

| | | | |
|---|---|---|---|
| 3,228,461 | 1/1966 | Seekins | 165/152 |
| 3,724,538 | 4/1973 | Yamaguchi et al. | 165/152 |
| 4,458,749 | 7/1984 | Melnyk | 165/906 X |

*Primary Examiner*—William R. Cline
*Assistant Examiner*—Richard R. Cole
*Attorney, Agent, or Firm*—R. L. Phillips

[57] ABSTRACT

A tube and fin heat exchanger is disclosed comprising a pair of tanks, a plurality of tubes of non-circular cross section connected at their ends to tanks, and a plurality of corrugated fin strips each arranged between and extending along the length of adjacent ones of the tubes. Each of the fin strips has a constant corrugation spacing extending along an intermediate and almost the entire length of the tubes and a smaller corrugation spacing extending the remainder of the length of the tubes to their ends so as to provide increased resistance to ballooning of the tubes at their ends by internal pressure.

2 Claims, 3 Drawing Figures

TUBE AND FIN HEAT EXCHANGER

TECHNICAL FIELD

This invention relates to tube and fin heat exchangers and more particularly to the fin structure thereof where the tubes have a non-circular cross section.

BACKGROUND OF THE INVENTION

In conventional tube and fin heat exchangers such as motor vehicle engine radiators where the tubes have a flat or oval shape cross section for minimum resistance to air flow through the core, there is a tendency for the tubes to balloon with pressure. For example, such flat tube heat exchangers must be structurally designed to withstand internal pressures during the coolant system filling operation at vehicle assembly as well as system pressures intentionally developed to increase coolant boiling point during vehicle operation. Under such pressurization, the unsupported flat or oval tube walls are subjected to severe bending movements developed from the internal pressure acting on the flattened portion of the tube. These bending moments are resisted until tensile stresses in the tube wall exceed the elastic material limit after which the tube plastically deforms and seeks a circular cross section. If a circular cross section is achieved before the tube bursts, the bending moment disappears stabilizing the cross sectional contour and leaving only circumferential tension and radial shear stresses. However, such ballooning then adds to the air flow resistance.

Moreover, wide flat tubes are known to improve the economics of tube and fin radiator designs by delaying the need for multiple tube rows in deeper cores and by increasing the overall thermal core efficiency by maximizing direct tube fin contact area. However, the bending moment mentioned above becomes more severe as tube width increases. Furthermore, many mass produced tube and fin heat exchangers maintain a gap between the header and the first fin convolution so as to provide a clearance to repair tube and/or header leaks in an assembled heat exchanger. However, as the length of the unsupported tube portion increases, the gap further amplifies the tube support problem by exposing unsupported tube length between the header and first fin convolution. And to maintain the flat or oval configuration under internal pressure, the tube depends strongly on the column support provided by the traversing fins. For example, an internally pressurized flat tube and fin heat exchanger with a gap between the header and first fin convolution typically experiences a tube ballooning problem that begins with a portion of unsupported tube between the header and first supporting fin convolution and propagates axially along the tube length. As the length of unsupported tube decreases, the threshold ballooning pressure increases to a value reflecting the maximum available support provided by a series of continuous columns, i.e. the fin convolutions. And thereafter, the tube ballooning problem will then begin in a random location within the core. Relating this to mass production, radiator families for example using similar tube designs are typically produced in several fin densities to offer a range or performance tailored to economically satisfy specific applications. But as a result due to the increased tube support per unit length, otherwise similar cores with increased fin density typically suffer tube ballooning problems as described above but at a higher threshold pressure level. And thus a minimum internal pressurization design specification must be withstood by the lowest fin density core within a family of heat exchangers using the same tube design. Due to section modulous considerations, a fin column is strongly dependent upon fin gage or thickness. And in high volume manufacturing, material gage consistency simplifies manufacturing tracking efforts and minimizes the potential for mixed parts. Fin gages are then constrained to assure that the minimum internal pressurization specification is met by the lowest fin density heat exchanger within a family utilizing the same tube design. However, the fin gage consistency constraint imposes a substantial fin material penalty on higher fin density cores which offer more tube support per unit length than their low fin density counterparts.

SUMMARY OF THE INVENTION

The present invention provides a simple low-cost, fin material saving solution to the above tube ballooning problem by negating the effect of the unsupported tube length. This is accomplished by simply locally compressing the fin convolution spacing (increasing the fin density) immediately adjacent the unsupported tube length so that the fin column strength supporting the tube is concentrated near the header where the tube ballooning would normally initiate. As a result, the tube ballooning resistances may then be increased to the level offered by a series of continuously supported columns, i.e. no header-center gap. And thus the material gages chosen for the fin may then be reduced as compared to fins with constant convolution spacing along the entire supported tube length.

These and other objects, features and advantages of the present invention will become more apparent from the following detailed description and accompanying drawings in which:

Figure 1:
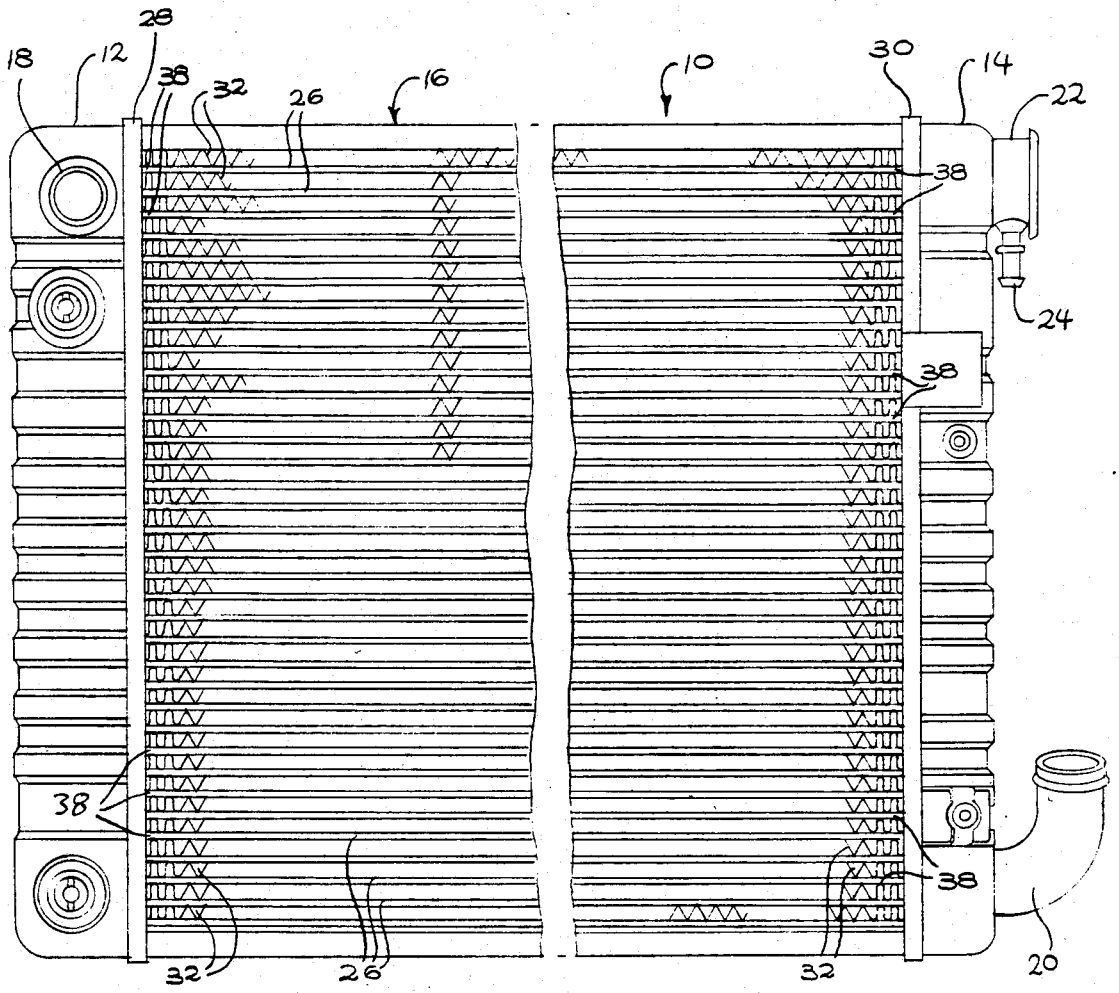
FIG. 1 is a front view of a flat tube and convoluted fin radiator for a motor vehicle's engine cooling system wherein the radiator has fins constructed according to the present invention.

Referring to the drawings wherein the same numbers are used to identify the same parts throughout the various views and like numbers only primed are used to identify similar or modified parts thereof, there is shown in FIG. 1 a flat tube and fin cross flow radiator generally designated as 10 used in the engine coolant system of a motor vehicle. The radiator basically comprises a pair of vertically oriented tanks 12 and 14 interconnected by a horizontally oriented liquid-to-air heat exchanger core 16 of flat tube and convoluted fin construction. The tanks 12 and 14 have an inlet pipe 18 and an outlet pipe 20, respectively, by which the radiator is connected in the engine cooling system with the tank 14 additionally having a fill pipe 22 and connected over flow pipe 24 by which the cooling system is filled and allowed to overflow, respectively.

The core 16 comprises a plurality of flat or oval shaped tubes 26 that are joined at their opposite ends to headers 28 and 30 which in turn join the core to the respective tanks 12 and 14 so as to interconnect the latter for liquid flow therebetween from the radiator inlet pipe 18 located at the top of the tank 12 to the radiator outlet pipe 20 located at the bottom of the other tank 14. The flat tubes 26 are arranged side-by-side in a single row across the width of the core and for increased heat transfer performance as well as support of the tubes against ballooning, the core is additionally provided with fins or air centers formed of corrugated strips 32 singularly arranged between the opposed flat sides 34 of each adjacent set of tubes. The fins are bonded at the crests of their convolutions to the respective tubes for good heat transfer relationship therewith and are formed so as to define with their convolutions a series of side-by-side parallel fin portions 36 extending the width of and at right angles to the tubes.

Figure 2:
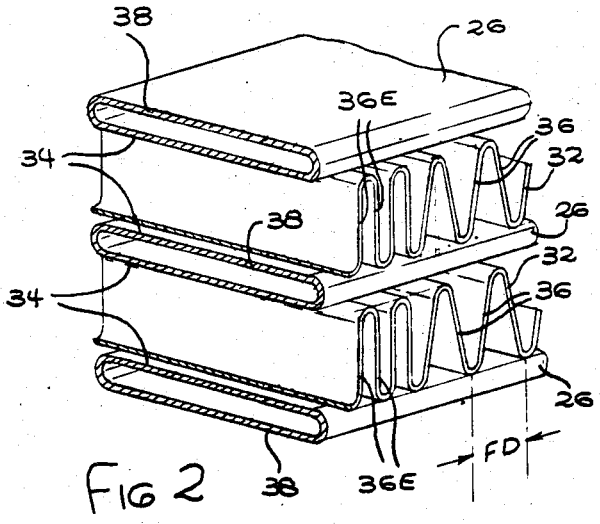
FIG. 2 is an enlarged isometric view of a section of the radiator core in FIG. 1.
Figure 3:
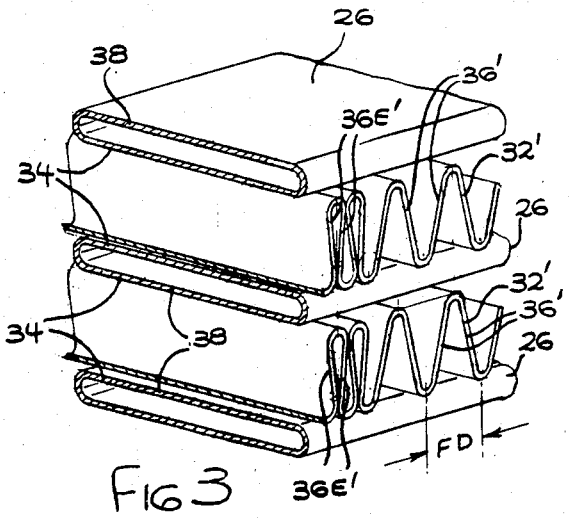
FIG. 3 is a view similar to FIG. 2 but showing another embodiment of the fin structure according to the present invention.

Normally, the fins have a fin density FD as shown in FIG. 2 of so many fin portions 36 (convolutions) per unit length that is constant along the entire length of the tubes. However, according to the present invention, such constant fin density is only maintained along an intermediate portion extending most of the length of the tubes and is locally increased or compressed immediately adjacent the unsupported tube length near the headers at the tube ends 38 as shown at one such end of the core in FIG. 2 where tube ballooning would normally initiate. Typically, the gap between the headers and the first fin convolution that provides clearance for repair of the tube and/or header leaks exceeds 3 mm and the best results that have been obtained thus far have been by providing six to eight more convolutions than is normal in such case and then compacting the last three or four convolutions at each end to about half their normal spacing to thereby substantially increase the fin density and thus the tube ballooning resistance as compared to a dimensionally equivalent heat exchanger with constant fin density over the entire supported tube length. As seen in FIG. 2, the thus compacted fin portions 36E are not only denser but are now at right angles to the tubes to help provide increased strength near the tube ends where they are unsupported immediately adjacent the headers. Another embodiment is shown in FIG. 3 wherein the fin portions 36E' of the fins 32' immediately adjacent the header plates are even further compacted with a resulting reverse angle so as to have more columns in effect located immediately adjacent the header plates and the unsupported ends of the tubes.

In actual tests, it has been found that with such strategic localized fin spacing or increased density near the unsupported ends of the tubes, the pressure limit before ballooning was increased by about 20% which is a very substantial improvement in the highly competitive manufacture of heat exchangers. For example, by utilizing the above invention, it is possible to substantially reduce the thickness of the fins and/or tubes while still maintaining adequate ballooning resistance. On the other hand, by retaining the same gage stock for the tubes and fins, it is then possible to increase the degree of applicability of one heat exchanger design to systems of otherwise too high a pressure range. Furthermore, it will be appreciated by those skilled in the art that other embodiments of the invention are possible and adaptable to other forms of tube and fin heat exchangers where the tubes have a non-circular cross section.

Thus, the above embodiments are intended to be illustrative of the invention which may be modified within the scope of the appended claims.

The embodiments of the invention in which an exclusive property or privilege is claimed are defined as follows:

1. A tube and fin heat exchanger comprising a pair of tanks, a plurality of tubes of non-circular cross section connected at their ends to said tanks, a plurality of corrugated fin strips each arranged between and extending along the length of adjacent ones of said tubes, characterized by each said fin strip having a constant corrugation spacing extending along an intermediate and almost the entire length of said tubes and further having a substantially smaller corrugation spacing extending the remainder of the length of the tubes to their ends so as to provide increased resistance to ballooning of the tubes at their ends by internal pressure.

2. A tube and fin heat exchanger comprising a pair of tanks, a plurality of flat-sided tubes connected at their ends to said tanks, a plurality of corrugated fin strips each arranged between and extending along the length of adjacent ones of said tubes, characterized by each said fin strip having a constant corrugation spacing extending along an intermediate and almost the entire length of said tubes so as to form fin portions inclined to the tubes and further having a substantially smaller corrugation spacing extending the remainder of the length of the tubes to their ends so as to form fin portions at substantially right angles to and adjacent the ends of the tubes to thereby provide increased resistance to ballooning of the tubes at their ends by internal pressure.

* * * * *